US005669551A

United States Patent [19]

Sigloch

[11] Patent Number: 5,669,551

[45] Date of Patent: Sep. 23, 1997

[54] PACKAGING FOR BOOKS AND/OR OTHER PRODUCTS AND METHOD AND APPARATUS OF THE PRODUCTION THEREOF

[75] Inventor: Helmut Sigloch, Kuenzelsau, Germany

[73] Assignee: Sigloch Verlag Service GmbH, Blaufelden, Germany

[21] Appl. No.: 759,934

[22] Filed: Dec. 4, 1996

Related U.S. Application Data

[63] Continuation of Ser. No. 336,124, Nov. 4, 1994, abandoned.

[30] Foreign Application Priority Data

Nov. 13, 1993 [DE] Germany ..... 43 38 799.3

[51] Int. Cl.[6] ..... B65D 5/48; B65D 5/32

[52] U.S. Cl. ..... 229/103.2; 229/23 R; 229/120.37; 229/939; 206/591

[58] Field of Search ..... 229/23 R, 103.2, 229/120.24, 120.37, 120.38, 939, 940; 206/424, 586, 591, 594

[56] References Cited

U.S. PATENT DOCUMENTS

| | | | |
|---|---|---|---|
| 1,479,328 | 1/1924 | Sinel | 229/103.2 |
| 1,677,918 | 7/1928 | Gallistel . | |
| 1,990,637 | 2/1935 | Daller | 229/23 R |
| 2,192,307 | 3/1940 | Green | 229/120.24 |
| 3,244,353 | 4/1966 | Miessler, Sr. | 229/939 |
| 3,357,631 | 12/1967 | Aid et al. | 229/23 R |
| 3,486,612 | 12/1969 | Kivell | 229/23 R |
| 3,487,914 | 1/1970 | Weaver et al. | 229/23 R |
| 3,900,101 | 8/1975 | Goodsite | 229/23 R |

FOREIGN PATENT DOCUMENTS

| | | | |
|---|---|---|---|
| 84679 | 11/1953 | Denmark | 229/23 R |
| 172133 | 2/1986 | European Pat. Off. | 229/120.24 |
| 808228 | 2/1937 | France | 229/23 R |
| 1186056 | 8/1959 | France | 229/23 R |
| 1217887 | 5/1960 | France | 229/23 R |
| 367102 | 3/1963 | France . | |
| 5330577 | 12/1993 | Japan | 206/586 |
| 955167 | 10/1961 | United Kingdom . | |

*Primary Examiner*—Gary E. Elkins
*Attorney, Agent, or Firm*—Shlesinger Artwright & Garvey, LLP

[57] ABSTRACT

A packaging, especially a machine-made container of paperboard, for instance for books. The packaging comprises four container surfaces and a projecting tab formed from a rectangular first blank having corresponding fold lines. The two remaining container surfaces consists of prefabricated hollow padding strips each of which is bonded by glue deposition at their undersides to the container bottom. After filling of the container, it is bonded by glue deposition at the top side with a closable cover having a free end that can be overlapped by a foldable projection firmly bonded to the projection using glue.

7 Claims, 5 Drawing Sheets

PACKAGING FOR BOOKS AND/OR OTHER PRODUCTS AND METHOD AND APPARATUS OF THE PRODUCTION THEREOF

This application is a continuation of application Ser. No. 08/336,124, filed Nov. 4, 1994, ABN.

FIELD OF THE INVENTION

The invention concerns a packaging made of folding material such as cardboard, paperboard or corrugated fiberboard and manufactured on machines, being closed on all sides, to form a generally right-parallelipipedic container for books and/or arbitrary products, comprising a uniform blank with four container surfaces (bottom, cover and two sides) folding about four parallel fold lines and further with a projecting tab. The invention furthermore concerns a method for packaging such products into said containers.

BACKGROUND OF THE INVENTION

Known packaging of the above cited species when used to ship books, video cassettes, disks and CD albums and other products while adequately protecting their contents in transit on the other hand entail comparatively high expense because the objects or sets of products are of much different sizes and always require different blanks, different tools and additional machine adjustment times. Moreover different packaging blanks for different series of products must be premanufactured and be on call to load the packaging manufacturing machine to capacity and thereby additional inventory costs for the blanks and the entailed space are incurred.

Moreover substantial drawbacks attach to known packaging blanks in that the end pads laterally bounding the product compartment start uniformly from both sides of the container bottom and as a result the blank is quite wide over part of its length. Said end pads attached to the blank are formed by raising and repeatedly folding their sides along pre-scored folding lines using shaping shoulders and plates adjustable in the package-manufacturing machine. The compartment of said shaping shoulders and plates requires substantial machine length whereby the paths and the timings are increased, and this in the light that limits are set on the rate of advance by the blank's edge, resting against machinery drive means, being precluded from deforming/destroying said edge in the vicinity of the lateral shaping plates. A high rate of affixation which is nevertheless desired in this respect results in reduced reliability and high rejection rates. Furthermore the end pads laterally appended to the blank's bottom and to be folded against it entail a disadvantageous shape of the blank which causes substantial waste and additional costs of waste removal.

OBJECTS AND SUMMARY OF THE INVENTION

The object of the invention is to improve a packaging of the initially cited kind in such manner that while averting the drawbacks of the state of the art, in particular the heretofore required many types of blanks, a blank entailing no wastes shall be created which shall match in simple manner arbitrary product formats and which can be speedily shaped into a closable container. Another object of the invention is to improve and simplify the method and the equipment for packaging objects by shorter manufacturing times and lower costs.

The problem of the invention concerning the product is solved by the features of the present invention. The packaging so improved is free of wrong cuttings, or wastes, because the first blank is rectangular which as such or as a unit allowing sub-division is supplied from the supplier or board manufacturer in already slightly cut form. The same advantages relate to the pre-fabricated end pads which also are folded from rectangular blanks and are bonded. Easy packaging-matching to arbitrary product formats is assured in that variable container heights and widths are provided by merely changing the distances between the fold lines of the first blank. As regards the end-pad blanks matched lengthwise to a given container width, the product compartment of the container can be enlarged or reduced at will by changing the fold-line separations and by correspondingly folding the product compartment.

A sequence of surfaces, namely cover, side, bottom, side, projecting tab, is determined in the first blank by fold lines of which changes in their separations entail containers with different heights and/or widths. The projecting tab serving to reliably close the container and externally bonded to the cover is used to achieve the above desired variability, and said tab is reduced to a minimum overlap in order to manufacture the surfaces required for a wider and/or higher container, or, in the reverse case, is enlarged by the amount of the remaining surfaces of a smaller container.

As a rule, when shipping books in particular, a gift is added to a copy for approval, and the product compartment may be divided by at least one hollow padding strip bonded to the bottom and located between the end pads. The product compartment may be sub-divided further by additional hollow padding strips to use the container as packaging for other products, where called for to serve as a finished gift container upon opening the cover, for instance for sets of jewelry, or sets of coffee, tea or soaps and the like. Depending on the kind of product, the material of the first and second blanks may also consist of plastic, sheetmetal or laminated cardboard besides paperboard.

In one variation, at least one of the end pads or one of the hollow padding strips is a folded, upwardly open receptacle with a rectangular bottom and of a height coinciding with that the packaging container and assumes the functions of an end pad and of an enclosure-item case. As regards the corrugated fiberboard second blank for the end pads and hollow padding strips, the fold lines preferably shall run transversely, ie perpendicularly to the direction of the corrugations.

End pads and hollow padding strips of different cross-sections may be manufactured from the same blank. The projection resulting in the mode of tightly adjacent fold lines is absorbed by doubling the material or by an additional fold line for an additional projection extending diagonally through the pad or padding cavity. The hollow padding strips each comprise four adjoining side segments and one projecting tab bonded on the inside or outside to a side segment. The projection also may form an external doubling of material at a side surface, the projection continuing outside the padding vicinity being available as bottom reinforcement and as additional bonding surface.

A partition to divide the product compartment also may be manufactured from the second blank in that its side walls being mutually bent together by 180°, ie doubled, by means of tightly adjoining fold lines, with projecting parts bondable to the container bottom starting from the side walls.

Additional advantages of the packaging of the invention result from the packaging method and from the packaging manufacturing machine of the invention. Because the end pads folded into rectangular hollow cross-sections and bonded into themselves are manufactured separately, this procedure may be carried out at least in part at the same time as the embossing and the scoring procedure for the fold lines on the first blank, whereby these manufacturing time intervals will be overlapping and the total manufacturing time shall be reduced. Because of the concept of manufacturing the end pads and other assembly components on a prefabrication line running for instance transversely to the length of the packaging-manufacturing machine, the total length of said machine also is reduced.

The length of the machine furthermore is advantageously reduced in that the first blanks are arrayed by their larger dimension (illustratively up to 850 mm) transversely to the path of advance and that accordingly only the smaller blank dimension (illustratively up to 400 mm) need be considered with respect to the lengths of the work stations. The compactness so achieved of the work stations and their smaller spacings make possible timed operation contributing to manufacturing reliability and a comparatively high speed of advance of approximately 0.7 m/s. Conventional blanks with laterally appended end pads on the other hand must be advanced in the direction of their largest dimension in order that the pads may be raised and folded back by lateral shaping plates along the way of advance, as a result of which the entailed large spacings between individual stations and the resistance offered to fold deformation exclude higher speeds of advance and the machinery is very long while manufacturing is comparatively slow. Moreover, as regards the packaging of the invention, the hollow padding strips bonded to the bottom ensure that the side walls raised at said paddings' open ends shall be firmly secured.

BRIEF DESCRIPTION OF THE DRAWINGS

The drawings schematically illustrate embodiment modes of the invention discussed below.

DETAILED DESCRIPTION OF THE PREFERRED EMBODIMENT

Figure 1:
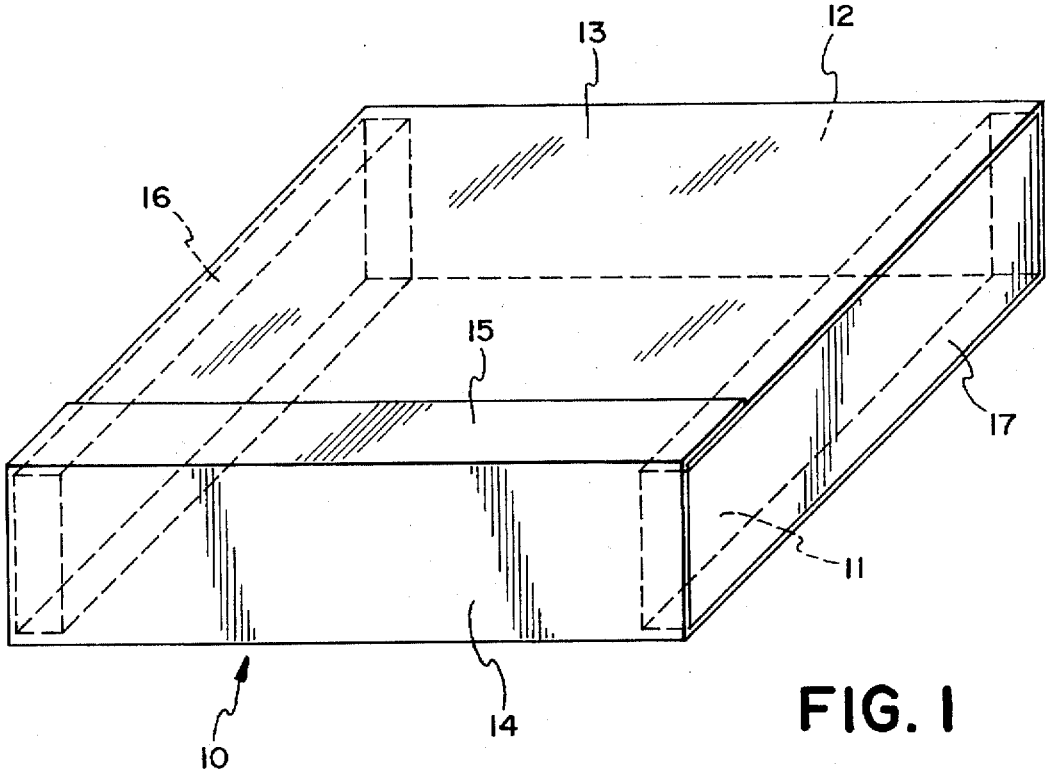
FIG. 1 is a perspective of a closed packaging of the invention.

As regards the packaging container of FIG. 1, a first blank 10 forms a bottom 11, an adjoining side wall 12 with adjoining cover 13, a side wall 14 starting from the opposite bottom side and a projecting tab 15 adjoining said side wall 14. The container is completed at its other side walls by two end pads 16, 17 of which the top and bottom sides bonded to the bottom 11 and cover 13 match the bounding length of a product compartment 18 subtended inside the container.

Figure 9:
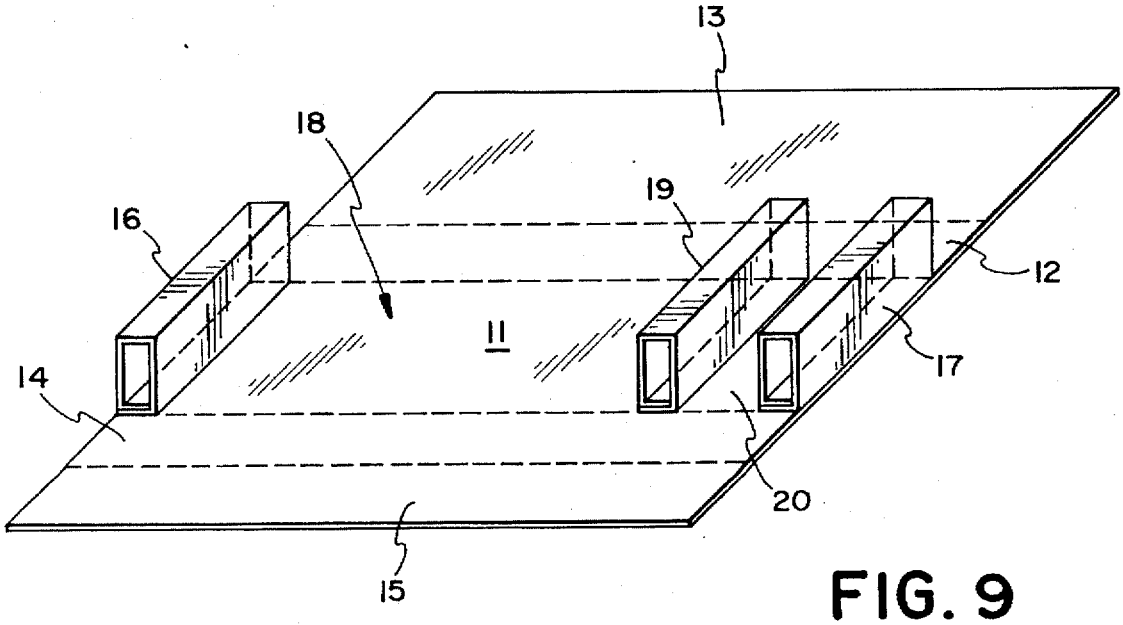
FIG. 9 shows a first blank with several joining parts.

FIG. 9 shows the as yet not folded blank 10 with the end pads 16, 17 already bonded to the bottom 11 and where an enclosure case 20 is separated by a padding/partition strip 19 from the product compartment 18.

Figure 2:
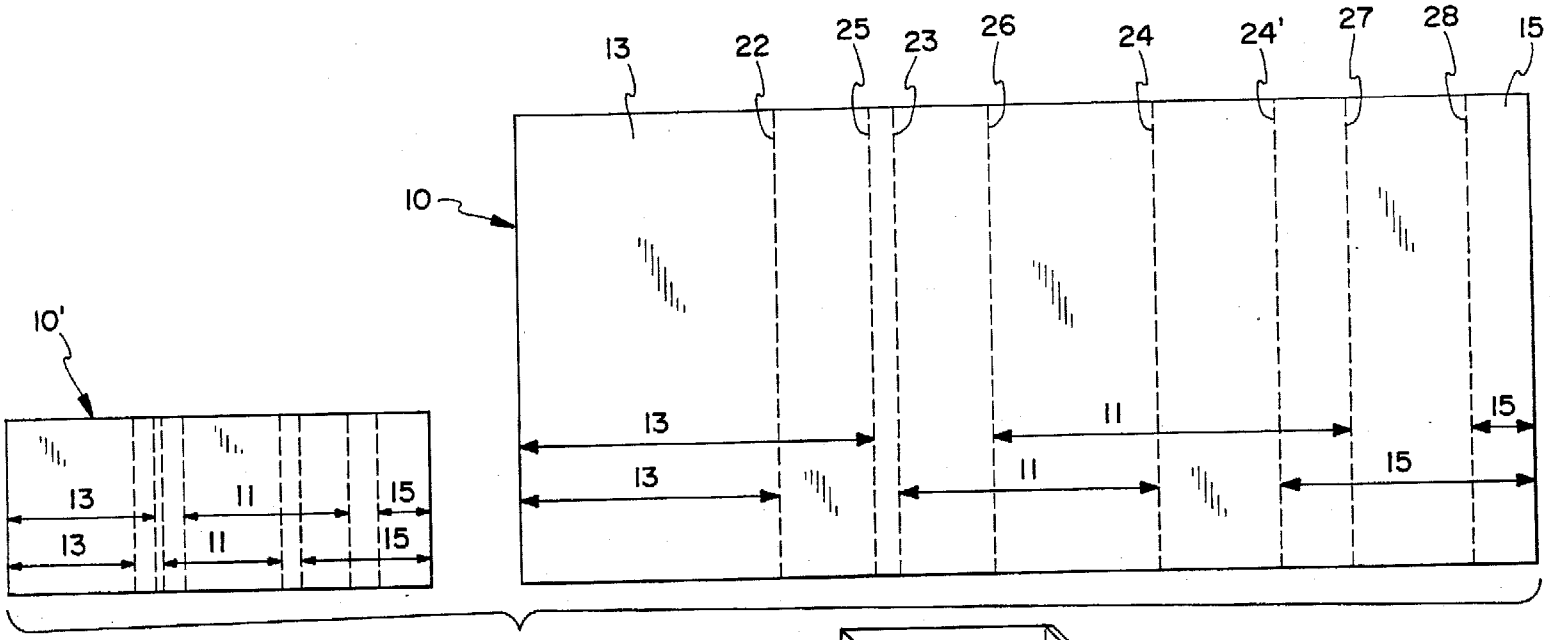
FIG. 2 shows a largest and a comparatively smallest first planar blank.

As regards the topview of FIG. 2 of the planar first blank 10 representing the initial step in the manufacture of the packaging container, illustratively two fold lines transverse to the longitudinal direction will be used for two possible container formats even though these fold lines, ie their separations may also be arrayed differently over the length of the blank 10. The fold line 22 determines a comparatively narrow cover 13 associated with a bottom 11, of the same size, between the fold lines 23, 24. The spacing between the fold lines 22–23 on one hand and between the fold lines 24–24' on the other hand determines the height of the container sides 12 and 14 resp. The residual projecting tab 15 shown on the right of the fold line 24' in FIG. 2 is about the same size as the bottom and cover.

In the second division of the blank 10, the fold line 25 subtends a comparatively large cover 13 matched by a bottom 11 of equal size and bounded by the fold lines 26–27. The side wall 12 generated in-between the fold lines 25 and 26 is matched by the equally large side wall 14 bounded by the fold lines 27 and 28. In this comparatively large container format, the blank 10 is used up except for a residual minimum width for the projecting tab 15. As regards smaller packagings or products, stepped intermediate blank sizes down to a smallest blank 10' illustratively shown in FIG. 2 will be used.

Figure 4:
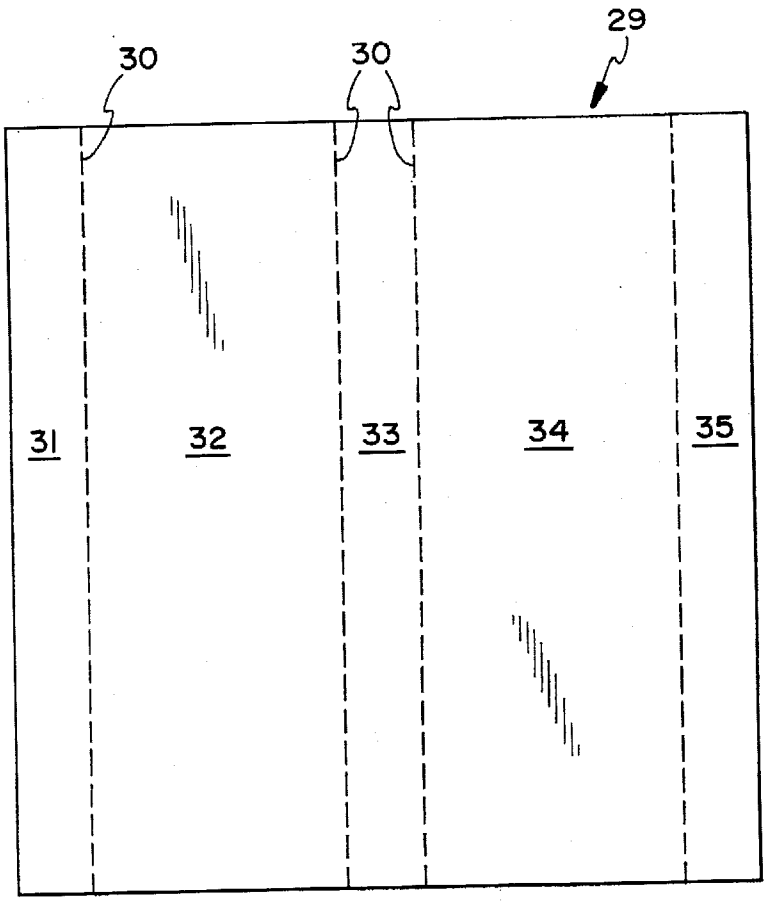
FIG. 4 is a topview of the planar blank for the hollow padding strip of FIG. 3.
Figure 3:
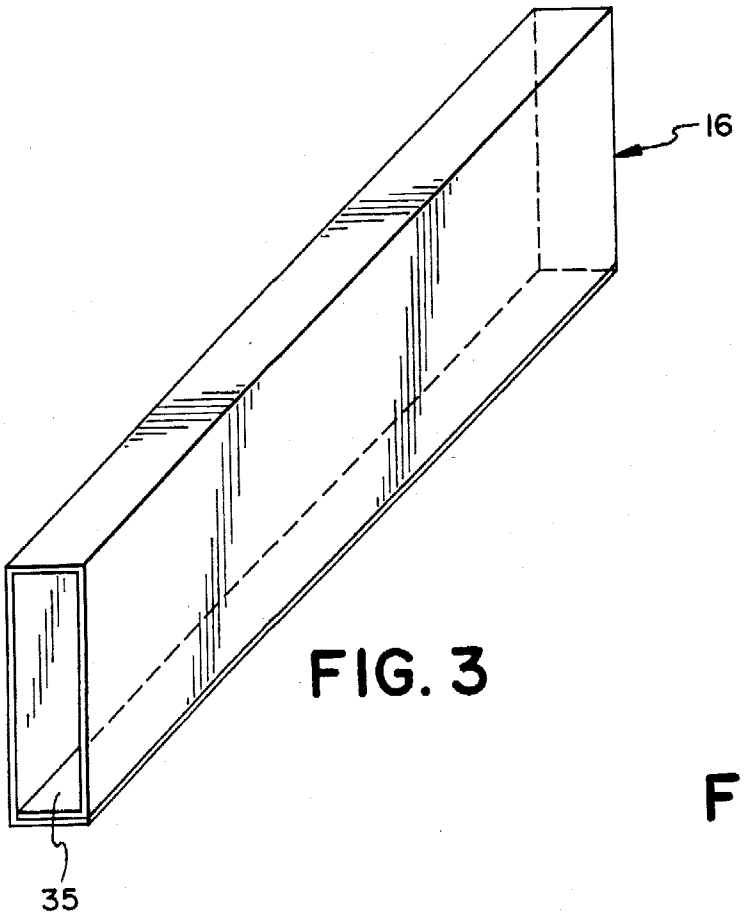
FIG. 3 is a perspective of a hollow padding strip.

The cross-sectionally rectangular end pads 16, 17 are pre-fabricated for instance from a square planar blank 29 such as shown in FIG. 4 which similarly to the first blank 10 comprises four fold lines 30 to subtend four sides forming a cross-sectional contour and an inwardly or outwardly extending, bonded projection 35. The spacings between the fold lines 30 of this second blank 29 can be changed arbitrarily to form shallower and wider end pads.

Figure 5:
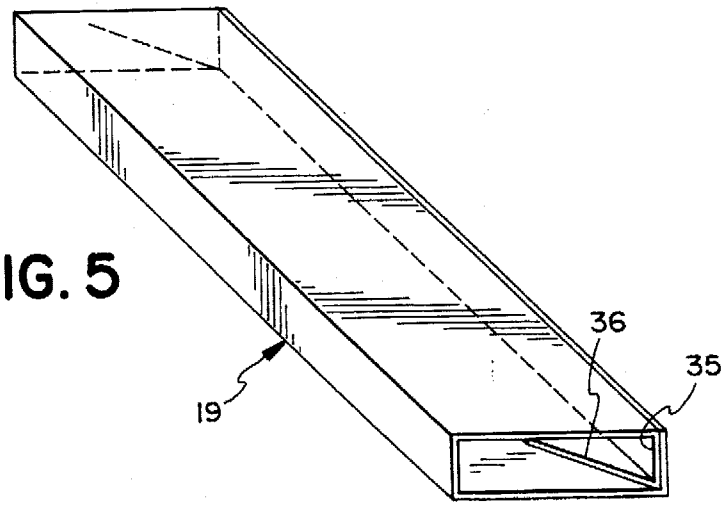
FIG. 5 is a hollow padding strip such as shown in FIG. 3 of which the projection or excess is received inside it.

Because the sum of the four cross-sectional widths of the hollow padding strip of FIG. 5 is small compared to the total width of the second blank 29, a large projection ensues and is subdivided into a segment 35 bonded to one of the structural sides and into a segment 36 remaining inside, appropriately making use of an additional fold line.

Figure 6:
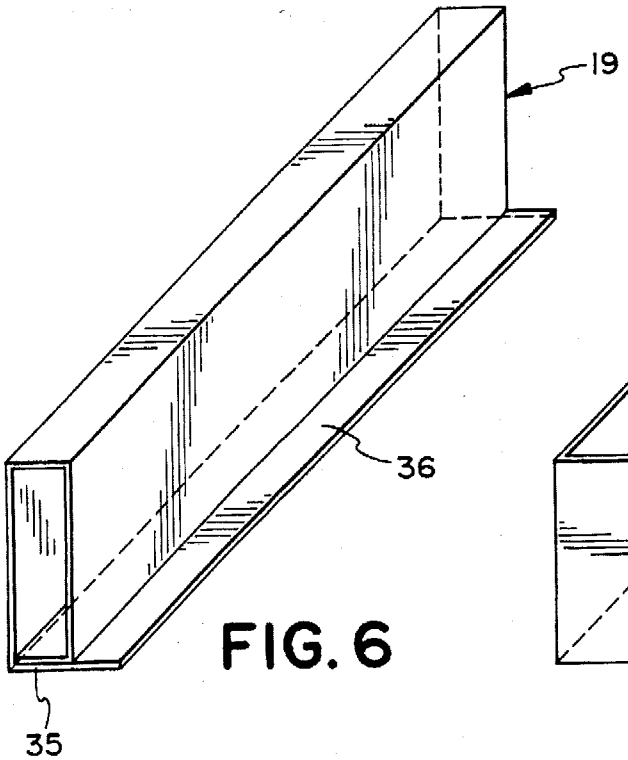
FIG. 6 is a hollow padding strip such as shown in FIG. 3, of which the projection extends beyond one of its sides.

As regards the hollow padding strip of FIG. 6, the total and large projection 35 represents an external extension located in the bottom plane and bonded to the strip bottom side. The hollow padding strips may be used both as end pads and as partition pads to divide the product compartment, in the latter case their cross-sections may be the same as or different from those of the end pads.

Figure 8:
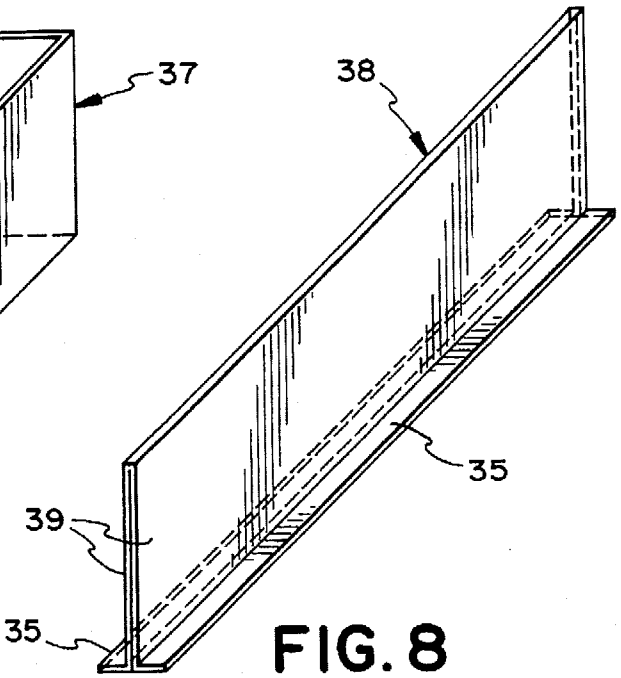
FIG. 8 is a partition.
Figure 7:
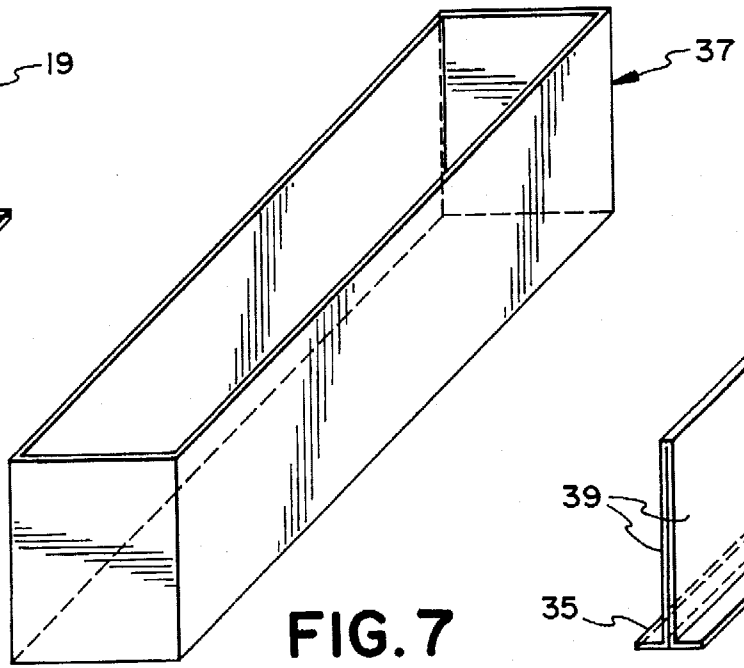
FIG. 7 shows an end or partition pad formed as an enclosure case.

When dividing the container into a product compartment and an enclosure case, a receptacle 37 with rectangular bottom made of folded cardboard or another material and shown in FIG. 7 may replace an end pad. This upwardly open receptacle appropriately is matched in its height to that of the packaging container. Furthermore, to divide the product compartment, a partition 38 shown in FIG. 8 may be used, which is made of a second blank 29, the side walls 39 resting against one another to form a double thickness on account of closely adjoining fold lines, projections 15 bonded to the container base 11 extending from each of said side walls 39.

Figure 10:
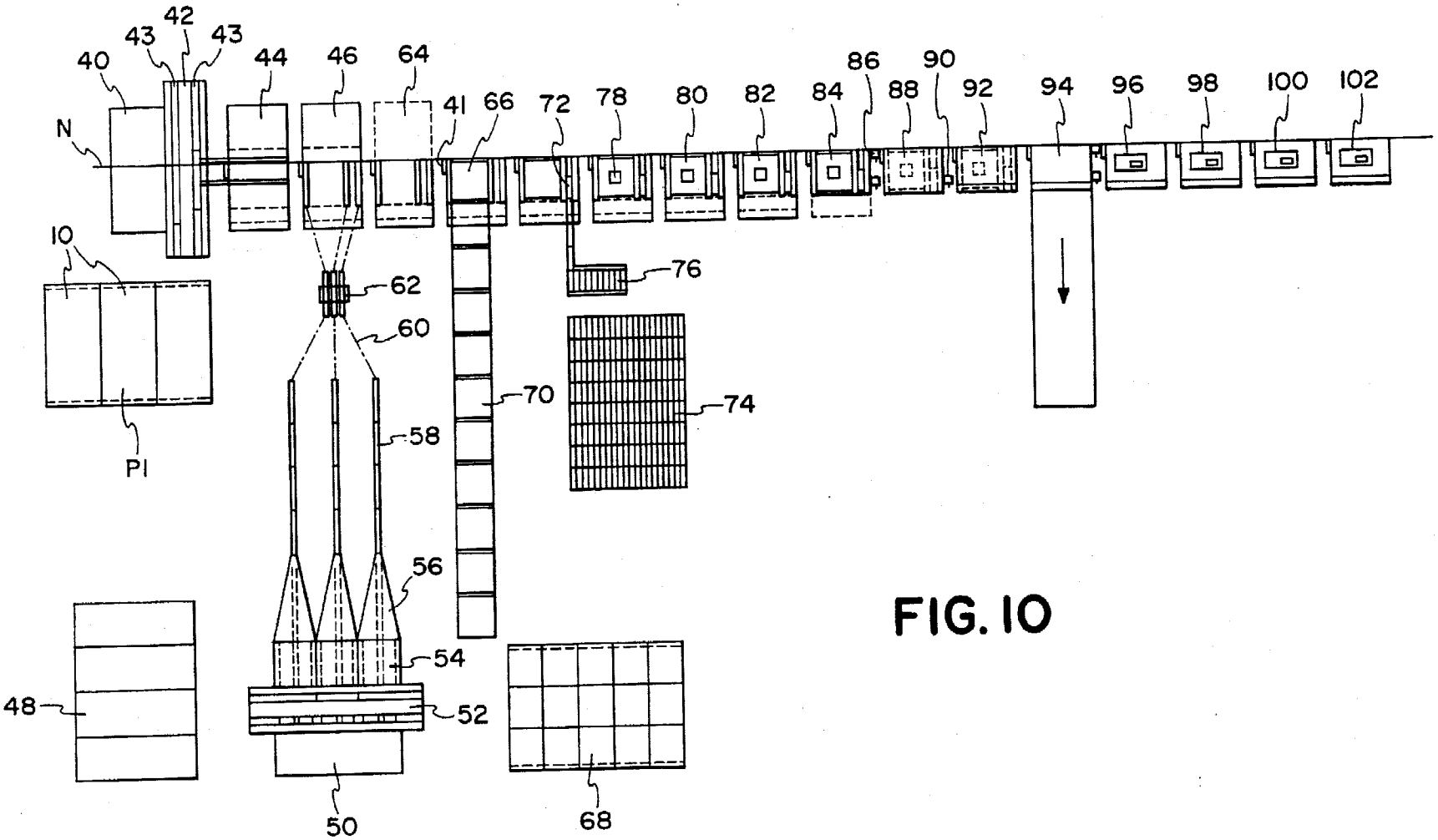
FIG. 10 is an overview of a packaging manufacturing machine of the invention.

In the embodiment mode of a packaging manufacturing machine shown in FIG. 10, the first or base planar blanks 10 arrive in sequence from a pallet stacker P1 at a feed station 40. Each blank is fitted with fold lines at a scoring station 42 implemented by two consecutive supported rollers 43 each bearing two adjustable scoring tools. One scoring tool of the first roller points at the continuous null line N passing through the entire machine. The embossed blanks are moved by conveyor belts from the scoring station 42 to a timed advance track passing through the machine, said track being fitted with advance chains with drive devices 41 mounted at specified timing intervals and stopping at each timing or work station. A transfer station 44 transfers and orients the blanks 10, and also orients the fold line running between the bottom 11 and a side wall 13 relative to the said null line N. As soon as the blank 10 is at rest in the ensuing joining station 46 during the timing interval of the chain conveyor, the end pads 16, 17 previously made on a separate manufacturing line, and where called for one or more hollow padding strips, are deposited on the bottom 12 of the blank 10.

The manufacturing line for the parts to be joined begins with a feed station 50 for individual layers removed from a pallet stacker 48 and illustratively dimensioned in such a way that they shall produce three second blanks 29. Each layer passes from the feed station 50 into a scoring and cutting station 52 where it is fitted by scoring tools of a first roller with fold lines and through cutting tools mounted on a second roller is divided into three blanks. The station 54 following the cutting roller corresponds approximately to the transfer station 44 of the overall machine which folds and bonds the individual blanks on separate paths of advance inside shaping stations 56 into rectangular hollow padding strips and, where appropriate, coats them with glue at their bottom side during a preset time window. The pre-fabricated hollow padding strips are buffered on the ensuing advance paths 58 by a gripper station 60 wherein one gripper each time assumes charge of the next three hollow padding strips together and brings them jointly in the direction of a glue-depositing roller station 62 and, following the glueing of their undersides, deposits them by means of guides at a specified separation on the bottom 11 of the blank 10.

Upon joining the hollow padding strips to the container bottom 11 in the joining station 46, the timed motion is resumed. The timing may be of the order of a second or somewhat less. Assuming an admissible speed of advance of 0.7 m/s and the station or chain spacings to be 500 mm when the smaller dimension of the largest blank, as measured in the direction of advance, is about 400 mm, then the time of conveyance, which together with the dwell time constitutes the timing, will be in this instance about 0.7 s. These assumptions allow ample dwell time for the particular procedure.

The container inside wall 12 is raised, ie erected, as far as into the null line N on the way to the station 64 and the cover is raiseduntil the next station 66. Because the chain-conveyor drive devices resting against the blank in the immediate vicinity of the null line, the resistance from the packaging material against being raised is transmitted in problem-free manner to the drive devices. Once the product compartment and the enclosure case have been readied inside the shipping carton by means of the hollow padding strips and further by the raised side wall 12, the product 70 that was readied in the insertion station 66 on a transverse conveyor line or roller track is simply and laterally shifted over a feed bench into the product compartment. An enclosure item previously moved from a stack of enclosure items 74 onto a guide 76 is displaced or inserted at the following insertion station 72 into the enclosure case.

The ensuing stations 78, 80 and 82 are to be used at will for instance to insert additional enclosure items such as brochures or fliers into the product compartment or the enclosure case. The second side wall 14 and the projecting tab 20 are raised in the second station 84, this procedure terminating once the shipping carton has reached this station. Two hot-adhesive nozzles 86 are present between the stations 84 and 88 above the line of conveyance in order to provide the top sides of the hollow padding strips with glue spots or beads onto which the cover shall be pressed and closed in the station 88. The glue is deposited on the top sides of the end pads and of the partition pad. The cover is closed using an omitted guide plate. A further hot-adhesive nozzle 90 is present between the stations 88 and 92 and deposits a bead of glue on the closed cover, the projecting tab 15 being closed on and pressed against said latter bead of glue.

An ensuing discharge station 94 serves to eject damaged or incomplete packagings detected by a shift register to the side of the conveyance line and to separate them early enough before the finished packagings will be stacked up. The next stations 96 through 102 perform conventional functions such as addressing, reading, coding, labeling etc., whereupon the finished packagings can be passed to a stacking device.

I claim:

1. A machine producible, fillable and closable parallelepiped container for packaging products comprising:

a) a sheathing member formed from a first uniform rectangular blank to produce container walls adjoining each other in one direction including a bottom wall, a first sidewall, a second sidewall a cover and a tab to overly said cover, each of said container walls are foldable with respect to each other about parallel fold lines formed on said first blank;

b) said first sidewall and said second sidewall extending from said bottom wall at opposite ends thereof and being extended by said cover and by said tab, respectively;

c) two end pads formed from identical second uniform rectangular blanks each of which is folded to produce a four sided open tube member having a rectangular cross-section, said two end pads forming two separate container walls including a third sidewall to provide a product compartment therebetween;

d) each of said second blanks comprising four sides and a projection foldable with respect to each other about parallel fold lines formed thereon with said projection adapted for gluing to one of said four sides, one side of each of said four sided tube members forming said two separate container walls matching the height of said container and the side opposite to said one side together with said container cover and said container bottom functions to limit said product compartment of said container; and e) said end pads adapted to be glued directly to said; container bottom wall prior to filling said product compartment and glued to said container cover after filling thereof while said tab is folded onto said container cover and affixed thereto by gluing.

2. Packaging defined in claim 1 and a) said product compartment bounded by said end pads including at least one partition adapted to be glued to said bottom.

3. Packaging as in claim 2, and wherein:

a) at least one of said end pads and one of said partitions forming an upwardly open receptacle having a rectangular bottom and a height equal to said parallelepiped container.

4. Packaging as in claim 2, and wherein:

a) said at least one partition is a folded padding strip having the generally cross-sectional shape of said tubular end pads and extending from said first sidewall to said second sidewall and formed from an additional one of said second uniform rectangular blanks.

5. Packaging as in claim 3 and wherein:

a) said open receptacle formed from a material selected from the group consisting of plastic and corrugated paperboard.

6. Packaging as in claim 5 and wherein:

a) said fold lines in said second rectangular blanks and said folded padding strips run transverse to the direction of the corrugations of said paperboard.

7. Packaging as in claim 1 and wherein:

a) said first uniform rectangular blank having additional fold lines formed thereon and operatively associated with said tab whereby the width of said tab may be selectively adjusted to vary the height and width of said container.

* * * * *